US009788098B1

(12) United States Patent
Roberts et al.

(10) Patent No.: US 9,788,098 B1
(45) Date of Patent: Oct. 10, 2017

(54) PROTECTIVE COVER FOR HEADPHONES

(71) Applicant: Charles Roberts, LLC, Newark, NJ (US)

(72) Inventors: Jon Paul Roberts, Jersey City, NJ (US); Stephanie Charles, Newark, NJ (US)

(73) Assignee: Charles Roberts, LLC, Newark, NJ (US)

( * ) Notice: Subject to any disclaimer, the term of this patent is extended or adjusted under 35 U.S.C. 154(b) by 0 days.

(21) Appl. No.: 14/975,819

(22) Filed: Dec. 20, 2015

Related U.S. Application Data

(60) Provisional application No. 62/098,194, filed on Dec. 30, 2014.

(51) Int. Cl.
*H04R 1/10* (2006.01)

(52) U.S. Cl.
CPC ..... *H04R 1/105* (2013.01); *H04R 1/1008* (2013.01); *H04R 1/1091* (2013.01)

(58) Field of Classification Search
CPC .... H04R 1/10; H04R 2205/022; H04R 1/105; H04R 5/0335; H04R 2201/10
USPC ..... 381/370–374, 380
See application file for complete search history.

(56) References Cited

U.S. PATENT DOCUMENTS

| | | | |
|---|---|---|---|
| 170,942 | A | 12/1875 | Edgar |
| 346,175 | A | 7/1886 | Shelby |
| D31,302 | S | 8/1899 | Sinclair et al. |
| 1,558,191 | A | 10/1925 | Lindemann |
| 2,020,084 | A | 11/1935 | Sidders |
| 2,149,383 | A | 3/1939 | Bean |
| 2,184,996 | A | 12/1939 | Jacobs |
| 2,211,184 | A | 8/1940 | Varell |
| 2,216,954 | A | 10/1940 | McDonough |
| 2,314,782 | A | 3/1943 | Goretsky |
| 2,377,739 | A | 6/1945 | Wyckoff |
| 2,420,245 | A | 5/1947 | Hurst |
| 2,437,049 | A | 3/1948 | Robert et al. |
| 2,444,251 | A | 6/1948 | Goldman |
| 2,447,078 | A | 8/1948 | Maxant |
| 2,450,703 | A | 10/1948 | Ivan |
| 2,504,826 | A | 4/1950 | Goldman |
| 2,507,375 | A | 5/1950 | Hartwell et al. |
| 2,552,476 | A | 5/1951 | Barton |
| 2,561,857 | A | 7/1951 | Goldman |
| 2,570,675 | A | 10/1951 | Morris |
| 2,582,907 | A | 1/1952 | Kaufmann |
| 2,615,169 | A | 10/1952 | Maxant |
| 2,622,159 | A | 12/1952 | Herman |
| 2,633,127 | A | 3/1953 | Scholl |
| 2,700,162 | A | 1/1955 | Fuller |
| 2,938,967 | A | 5/1960 | Guardino |
| 3,030,458 | A | 4/1962 | Gongoll |

(Continued)

*Primary Examiner* — Suhan Ni
(74) *Attorney, Agent, or Firm* — Werschulz Patent Law, LLC

(57) ABSTRACT

A low profile earphone cover comprising a layer of soft, minimally absorbent mesh fabric and a flexible adhesive layer configured for affixing the cover on the ear pad of an earphone. The earphone cover is minimally visible, maintaining the original appearance of earphone. The earphone cover protects the ear pad from damage from sweat and bacteria and increases the comfort of the user by drawing sweat away from the surface of an ear's auricle.

6 Claims, 3 Drawing Sheets

(56) References Cited

U.S. PATENT DOCUMENTS

| | | | | |
|---|---|---|---|---|
| 3,119,119 | A | 1/1964 | Millinger et al. | |
| 3,238,313 | A | 3/1966 | Kalogris | |
| 3,249,949 | A | 5/1966 | Rosenberg et al. | |
| 3,301,254 | A | 1/1967 | Schickendanz | |
| 3,588,914 | A | 6/1971 | Inhat | |
| D244,300 | S | 5/1977 | Besasie | |
| D254,876 | S | 5/1980 | Reitenga et al. | |
| 4,308,623 | A | 1/1982 | Voorhees | |
| 4,403,120 | A * | 9/1983 | Yoshimi | H04R 1/225 381/374 |
| 4,546,215 | A | 10/1985 | Ferraro | |
| 4,597,469 | A | 7/1986 | Nagashima | |
| 4,616,643 | A | 10/1986 | Jung | |
| 4,654,898 | A | 4/1987 | Ishikawa | |
| 4,658,931 | A * | 4/1987 | Curry | A61F 11/14 381/372 |
| 4,660,229 | A | 4/1987 | Harris | |
| 4,783,822 | A | 11/1988 | Toole et al. | |
| 4,791,684 | A | 12/1988 | Schwartz | |
| D301,477 | S | 6/1989 | Storyk | |
| 4,850,055 | A | 7/1989 | Hwang | |
| 4,872,219 | A | 10/1989 | Duncan | |
| D307,753 | S | 5/1990 | Oliver | |
| 4,935,965 | A | 6/1990 | Wassell | |
| D324,386 | S | 3/1992 | Oblinger | |
| 5,138,722 | A | 8/1992 | Urella et al. | |
| 5,233,650 | A | 8/1993 | Chan | |
| D344,611 | S | 2/1994 | Hordis | |
| 5,339,467 | A | 8/1994 | Brinkley | |
| 5,357,585 | A * | 10/1994 | Kumar | H04R 1/1008 381/373 |
| D390,564 | S | 2/1998 | Savona | |
| 5,778,455 | A | 7/1998 | Joseph | |
| 5,881,390 | A | 3/1999 | Young | |
| 5,996,123 | A | 12/1999 | Leight et al. | |
| D434,877 | S | 12/2000 | Harral | |
| 6,298,493 | B1 | 10/2001 | Ambroise | |
| 6,310,961 | B1 | 10/2001 | Oliveira et al. | |
| 6,392,196 | B1 | 5/2002 | Lin | |
| 6,427,018 | B1 | 7/2002 | Keliiliki | |
| 7,058,985 | B2 | 6/2006 | Tanaka | |
| 7,480,388 | B1 | 1/2009 | Crook | |
| D606,970 | S | 12/2009 | Semcken | |
| 7,697,709 | B2 | 4/2010 | Mei et al. | |
| 8,358,799 | B1 * | 1/2013 | Gresko | H04R 1/1058 381/370 |
| 8,440,274 | B2 | 5/2013 | Wang | |
| 8,474,064 | B2 | 7/2013 | Hardy | |
| D688,648 | S | 8/2013 | Li et al. | |
| 8,662,244 | B2 | 3/2014 | Fishberger et al. | |
| D702,209 | S | 4/2014 | Lee | |
| D715,271 | S | 10/2014 | Lee | |
| 2010/0135515 | A1 | 6/2010 | Walsh | |
| 2011/0081036 | A1 | 4/2011 | Brown | |
| 2013/0296994 | A1 | 11/2013 | Vaishya | |
| 2013/0343595 | A1 | 12/2013 | Zorkendorfer et al. | |
| 2014/0177897 | A1 | 6/2014 | Baik | |

* cited by examiner

PROTECTIVE COVER FOR HEADPHONES

CROSS-REFERENCE TO RELATED APPLICATIONS

This application is a nonprovisional utility application of the provisional patent application, Ser. No. 62/098,194, filed in the United States Patent Office on Dec. 30, 2014 and claims the priority thereof and is expressly incorporated herein by reference in its entirety

TECHNICAL FIELD

The present disclosure relates generally to a protective cover. More particularly, the present disclosure relates to a protective cover for an ear pad of an earphone.

BACKGROUND

As a result of the rapid progress in science and technology, personal digital products are popular due to the increase in functionality and quality with a concurrent reduction in price. Current portable electronic devices, such as smartphones, tablets and media players, have even grown to be indispensable in our daily life. These portable electronic devices are integrated with many functions, including providing a variety of means for audio playback to the user. These devices generally include integrated speakers, or alternatively, audio output jack(s) for allowing a user to receive audio playback by way of headphones (referred to herein as "earphones") and earbuds coupled to the audio output jack(s).

Earphones have become a necessary accessory to portable electronic devices and provide consumers with numerous benefits. When the ear pads of the earphones are placed on the user's ears, a temporary seal is created around or on the user's ear so that the earphone speakers can transmit sound waves directly into the user's ear with minimal external latent noise. Earphones allow a user to listen to audio information provided by the portable electronic device without disturbing other people that may be present. Additionally, earphones provide a listener with better audio transmission so the listener can clearly hear and understand the content of the audio playback from the electronic device. Generally, earphones provide a user with improved audio quality and a sense of privacy.

When earphones combine with a microphone, they are referred to as headsets. These headsets allow the user to carry on a telephone or videoconference conversation, providing privacy and diminishing interference from outside noise. These headsets are often worn for many consecutive hours in a row by people involved with telemarketing, support help lines or receptionists.

However, with the constant use of earphones, there are difficulties presented with keeping the earphones clean and sanitary. Dust, sweat, germs and other environmental factors can collect on the earphones. The temporary seal between the earphone and the outer ear create an environment conducive to sweat production, trapping moisture between the ear pad and the ear, creating an environment prone to the production of bacteria. Additionally, leaving earphones out when they are not in use may allow dust particles to collect or enter the ear-pad.

Prior art earphone covers generally fit over the entire earphone, similar to a shower cap over a head. Not only is this style of cover visually unappealing, but it also directly covers the speaker of the earphone, which effects the quality of sound.

While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide an earphone cover that does not allow sweat to build up between a user's ear and an ear pad on an earphone. Accordingly, an aspect of an example embodiment in the present disclosure provides an earphone cover having a mesh fabric layer contacting the ear, allowing air to flow within the ear pad, thereby minimizing sweat and channel moisture away from the ear.

Another aspect of an example embodiment in the present disclosure is to provide an earphone cover that is reusable and washable. Accordingly, an aspect of an example embodiment in the present disclosure provides an earphone cover having a flexible sticky layer configured for selectively adhering to an ear pad, the earphone cover selectively removed, selectively washed and applied repeatedly.

A further aspect of an example embodiment in the present disclosure is to provide an earphone cover that maintains the ear pad in place on an ear. Accordingly, an aspect of an example embodiment in the present disclosure provides a mesh fabric layer with a coefficient of friction sufficient to maintain the ear pad in place.

Yet another aspect of an example embodiment in the present disclosure is to provide an earphone cover that maintains the sound quality produced by the earphone speakers. Accordingly, an aspect of an example embodiment in the present disclosure provides an earphone cover with a center opening that allows the sound to travel from the speaker in the earphone directly to the ear without interference.

Yet a further aspect of an example embodiment in the present disclosure is to provide an earphone cover that fits most ear pads without altering the appearance of the ear pads. Accordingly, an aspect of an example embodiment in the present disclosure provides an earphone cover with a low profile, and a perimeter that is adaptable to a plurality of ear pad shapes with a conforming rim or as in another example embodiment, the perimeter is rimless and can be trimmed to conform to the plurality of ear pad shapes.

The present disclosure describes a low profile earphone cover comprising a layer of soft, minimally absorbent mesh fabric and a flexible adhesive layer configured for affixing the cover on the ear pad of an earphone. The earphone cover is minimally visible, maintaining the original appearance of earphone. The earphone cover protects the ear pad from damage from sweat and bacteria and increases the comfort of the user by drawing sweat away from the surface of an ear's auricle.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

Figure 1:
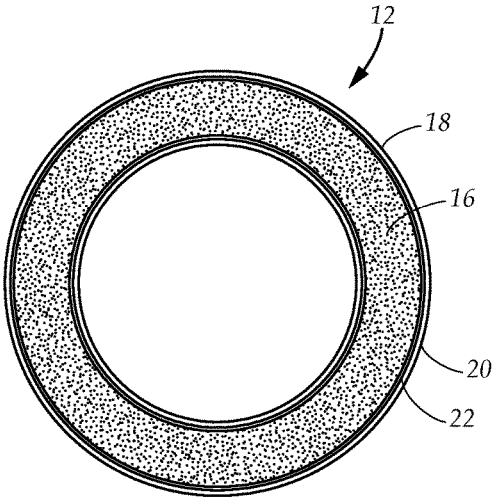
FIG. 1 is a top plan view of an example embodiment of an earphone cover.
Figure 2:
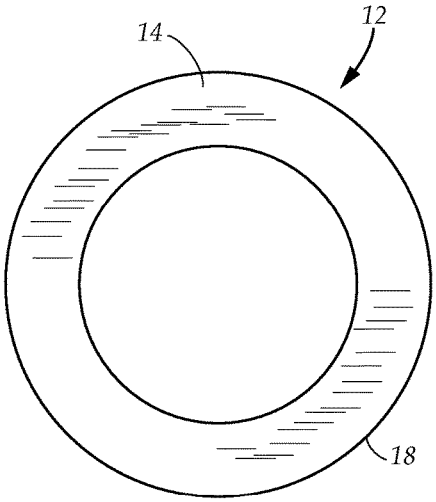
FIG. 2 is a bottom plan view of the example embodiment of the earphone cover.
Figure 3:
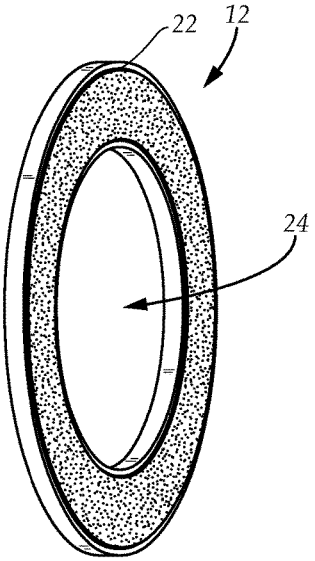
FIG. 3 is a perspective view of the example embodiment of the earphone cover.
Figure 4:
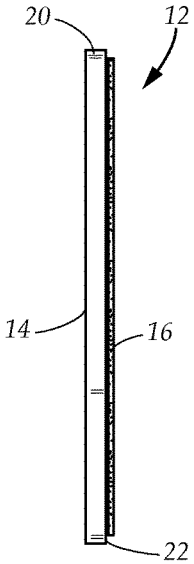
FIG. 4 is a side elevational view of the example embodiment of the earphone cover.
Figure 5:
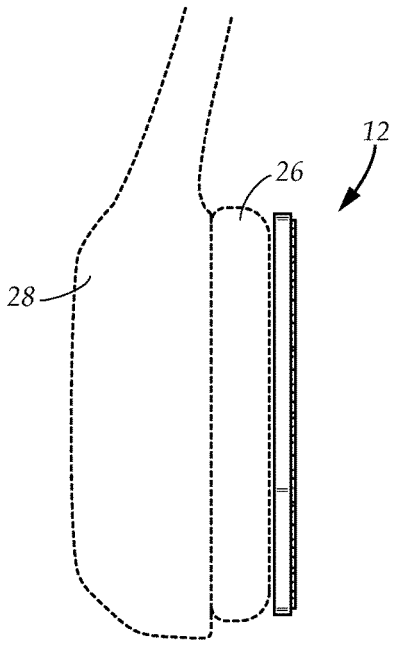
FIG. 5 is a side elevational view of the example embodiment of the earphone cover attaching to an ear pad on an earphone.
Figure 6:
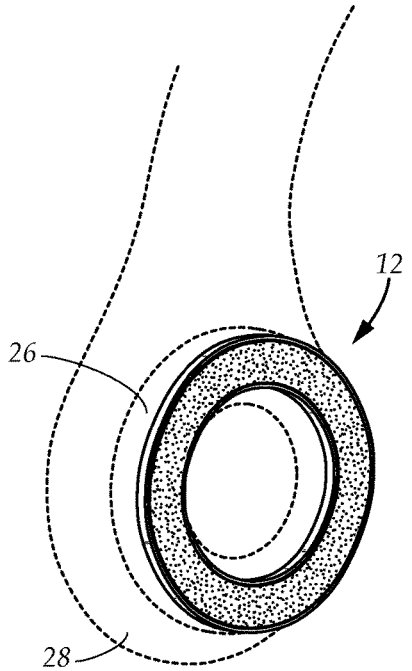
FIG. 6 is a perspective view of the example embodiment of the earphone cover attaching to the ear pad on the earphone.
Figure 7:
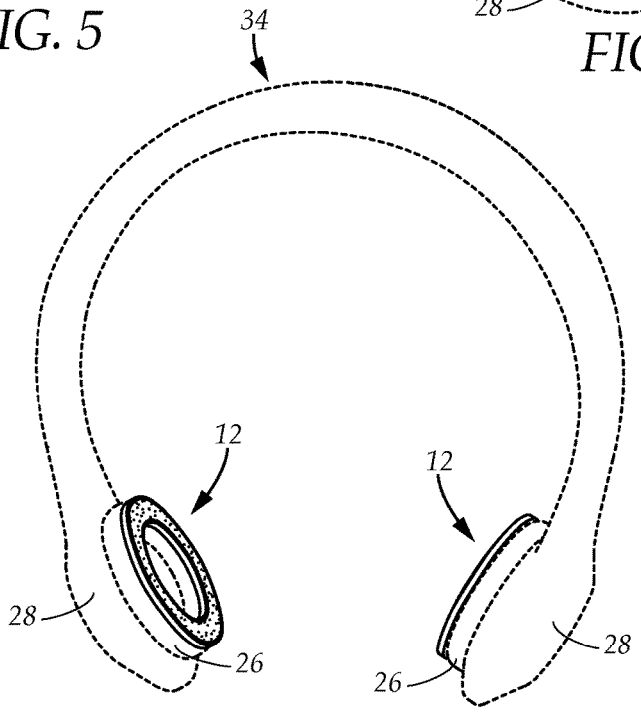
FIG. 7 is a perspective view of the example embodiment of a pair of the earphone covers attaching to the ear pad on the earphone.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

FIGS. 1-7 illustrate an example embodiment of an earphone cover 12 for covering an ear pad 26 of an earphone 28. The earphone cover 12 has a flexible sticky layer 14 configured for selectively adhering to the ear pad 26. The earphone cover 12 further has a mesh fabric layer 16 attaching to the flexible sticky layer 14. The mesh fabric layer 16 is configured for contacting an ear directly when the earphone cover 12 is adhering to the ear pad 26.

For the purposes of this disclosure, the term earphone 28 refers to a device having a small speaker within an ear cup designed to be held in place close to a user's ears. Generally, earphones are in pairs held by a band 34 over the top of the head to the earphones 28 pressing against or covering an auricle of the ear. The earphones 28 have ear pads 26 with an outer surface generally made from leather or another durable, pliable fabric surrounding soft closed cell foam.

Earphones 28 come in several types: a circumaural having large pads surrounding the outer ear with circular or ellipsoid ear pads, and supra-aural earphones that press against the ears. It is understood by those of ordinary skill in the art that the type of earphone is not a limitation and the earphone cover 12 is useful for all types of earphones, whether or not provided in pairs or as a single earphone 28 on a headset.

The sticky layer 14 of the earphone cover 12 has an outer perimeter 18 with a rim 20 on the perimeter. The rim 20 creates a shallow channel 22 and the mesh fabric layer 16 is disposed within the channel creating a low profile for the earphone cover 12. The mesh fabric layer 16 is glued to the sticky layer when placed in the channel 22.

In one example embodiment, the earphone cover 12 has a center opening 24 to minimize sound distortion between the speakers in the earphone 28 and a user's ear. The center opening 24 allows sound to travel directly from the speaker to the ear.

The flexible sticky layer 14 comprises a tacky silicone material that has an inherent tackiness that allows the earphone cover 12 to selectively adhere to the ear pad 26. The silicone material is flexible so that the earphone cover 12 conforms to an ear pad shape.

The mesh layer 16 has a textured surface contacting the ear, providing a coefficient of friction sufficient to maintain the ear pad 26 in place.

The flexible earphone cover 12 allows for minimal sound degradation. Because the ear pad 26 is designed to fit snugly on the ear auricle, it is an important consideration that the earphone cover 12 does not prevent the ear pad from snugly fitting onto the auricle in order to shut out external sound that interferes with sound coming from the earphones 28. The earphone cover 12, having a flexible sticky layer 14 and a mesh fabric layer 16 that is inherently flexible, follows the contours of the ear pad 26 when it is pressed against the auricle, making a snug fit resulting in an effectively similar external sound limiting fit between the earphone 28 and the user's ear.

The mesh fabric layer 16 allows airflow within the earphone cover 12 to minimize sweating. The mesh fabric layer 16 is minimally absorbent so that moisture is not held by the earphone cover, avoiding potential conditions for bacterial growth. The mesh fabric layer 16 also does not wick moisture from the ear, only for the flexible adhesive layer 14 trapping it within the earphone cover 12. Instead, the airflow within mesh fabric prevents moisture from being generated from sweating.

The earphone cover 12 provides a moisture-free, sanitary surface for the user's ear to rest against and is selectively applied to the ear pad 26. The earphone cover 12 is repeatedly washable, allowing the user to have a fresh surface after repeatedly using earphones 34. The mesh fabric in the fabric layer 16 is washable. Because the silicone material in the flexible sticky layer 14 is inherently tacky, the earphone cover 12 can be repeatedly washed without losing the ability to adhere to the ear pad 26.

The earphone cover 12 extends the usable lifetime of the earphones 28 by reducing wear and tear on the ear pads 26, keeping them clean and minimizing any abrasions from rubbing against other surfaces, such as when the earphones are stored.

Figure 8:
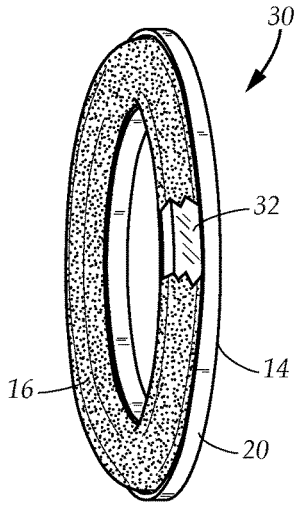
FIG. 8 is a perspective view of another example embodiment of the earphone cover.

FIG. 8 shows another example embodiment of the earphone cover 30. The earphone cover 30 shown has an oval shape. Between the mesh fabric layer 16 and the flexible sticky layer 14, is a layer of padding 32. The mesh fabric layer 16 and padding 32 extend slightly beyond the rim 20, but maintain the low profile relative to an ear pad.

Figure 9:
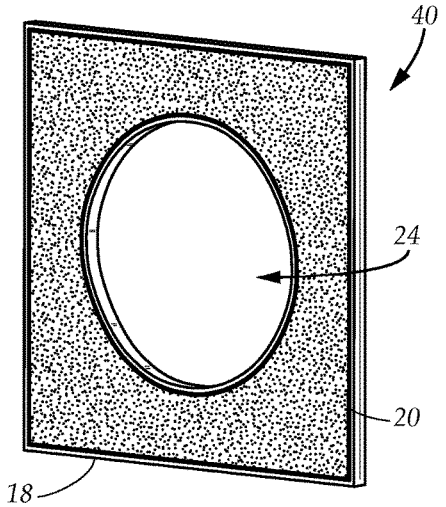
FIG. 9 is a perspective view of a further example embodiment of the earphone cover.

FIG. 9 shows yet another example embodiment of the earphone cover 40. The perimeter 18 is quadrilateral and the rim 20 conforms to the shape of the perimeter 18. The opening 24 is annular.

Figure 10:
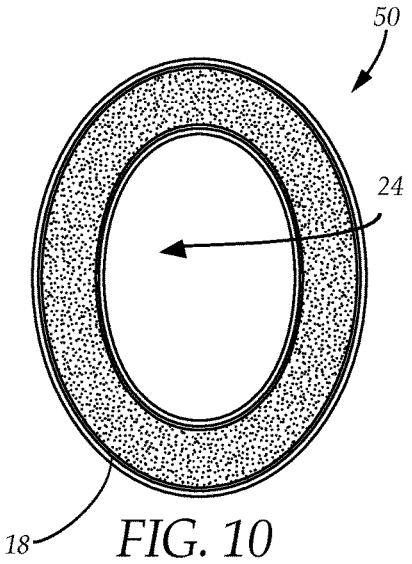
FIG. 10 is a top plan view of another example embodiment of the earphone cover.

FIG. 10 shows yet a further example embodiment of the earphone cover 50. The perimeter 18 is oval and the rim 20 conforms to the shape of the perimeter 18. The opening 24 is elliptical. FIG. 9 and FIG. 10 considered together demonstrate that the perimeter 18 and opening 24 of the earphone cover is selectively adaptable to the configuration of any ear pad.

Figure 11:
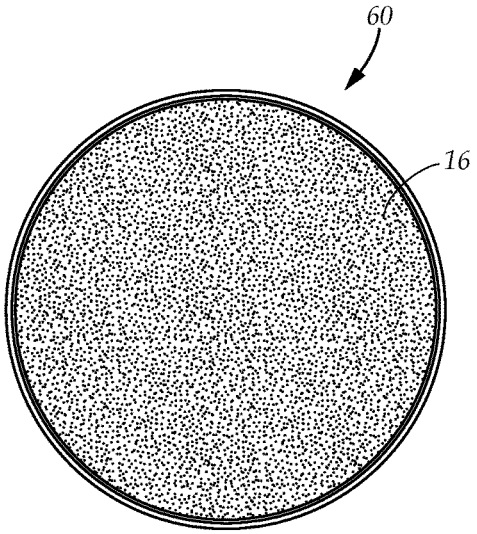
FIG. 11 is a top plan view of yet a further example embodiment of the earphone cover.

FIG. 11 illustrates still another example embodiment of the earphone cover 60 lacking an opening, the mesh layer 16 continuous within the perimeter 18. Under some conditions, the opening is not desirable or a solid cover is desired. The lack of the opening is useful for applications were high fidelity is not required, such as with a headset. In a still further example embodiment, the earphone cover 60 lacks a rim at the perimeter. This allows the user to trim the earphone cover to any shape or configuration desired.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented an earphone cover. The disclosure is illustrated by example in the drawing figures, and throughout the written description. It should be understood that numerous variations are possible, while adhering to the inventive concept. Such variations are contemplated as being a part of the present disclosure.

What is claimed is:

1. An earphone cover for covering an ear pad, comprising:

a flexible sticky layer configured for selectively adhering to the ear pad, the flexible sticky layer comprising tacky silicone material that is repeatedly washable, maintaining the sticky layer for repeatedly adhering to the ear pad, the sticky layer having a shallow channel; and a mesh fabric layer attaching to an adhesive layer disposed within the shallow channel of the flexible sticky layer, the mesh fabric layer having a textured surface configured for contacting the ear, providing a coefficient of friction sufficient to maintain the ear pad in place, the earphone cover maintaining a low profile when adhering to the ear pad.

2. An earphone cover for covering an ear pad, comprising:

a center opening;

a round flexible sticky layer configured for selectively adhering to the ear pad, the flexible sticky layer forming a shallow channel; and a mesh fabric layer attaching to an adhesive layer conforming to the shape of the round flexible sticky layer, the mesh fabric layer disposed within the shallow channel of the flexible sticky layer, the mesh fabric layer configured for contacting an ear.

3. The earphone cover as described in claim 2, wherein the earphone cover has a low profile when adhering to the ear pad.

4. The earphone cover as described in claim 3, wherein the flexible sticky layer further comprises a tacky silicone material.

5. The earphone cover as described in claim 4, wherein the earphone cover is repeatedly washable, maintaining the sticky layer for repeatedly adhering to the ear pad.

6. The earphone cover as described in claim 5, wherein the mesh layer has a textured surface contacting the ear, providing a coefficient of friction sufficient to maintain the ear pad in place.

* * * * *